US012173937B2

(12) United States Patent
Sun et al.

(10) Patent No.: US 12,173,937 B2
(45) Date of Patent: Dec. 24, 2024

(54) STEPPED SELF-CONVECTION CONDENSER

(71) Applicant: ZHEJIANG UNIVERSITY, Zhejiang (CN)

(72) Inventors: Zhilin Sun, Hangzhou (CN); Chaoqun Zhai, Hangzhou (CN); Yizhi Sun, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 0 days.

(21) Appl. No.: 18/423,332

(22) Filed: Jan. 26, 2024

(65) Prior Publication Data

US 2024/0159435 A1 May 16, 2024

Related U.S. Application Data

(63) Continuation of application No. PCT/CN2022/111090, filed on Aug. 9, 2022.

(51) Int. Cl.

| | |
|---|---|
| ***F25B 39/04*** | (2006.01) |
| ***F28B 1/02*** | (2006.01) |
| ***F28B 9/08*** | (2006.01) |

(52) U.S. Cl.

CPC ..... *F25B 39/04* (2013.01); *F28B 1/02* (2013.01); *F28B 9/08* (2013.01)

(58) Field of Classification Search

CPC ..... F28B 9/08; F28B 1/02; F25B 39/04

See application file for complete search history.

(56) References Cited

FOREIGN PATENT DOCUMENTS

| | | | |
|---|---|---|---|
| CA | 2692229 | A1 | 9/2011 |
| CN | 102721299 | A | 10/2012 |
| CN | 102865762 | A | 1/2013 |
| CN | 103033075 | A | 4/2013 |
| CN | 204063689 | U | 12/2014 |
| CN | 205561592 | U | 9/2016 |
| CN | 110595114 | A | 12/2019 |
| CN | 111220004 | A | 6/2020 |

(Continued)

OTHER PUBLICATIONS

International Search Report (PCT/CN2022/111090); Date of Mailing: Apr. 21, 2023.

(Continued)

*Primary Examiner* — Devon Russell

(74) *Attorney, Agent, or Firm* — W&G Law Group

(57) ABSTRACT

A stepped self-convection condenser comprising a stepped heat absorbing pipe, a stepped steam pipe, a curved water collecting pipe, a condensed water collecting chamber and a heat insulation shell; the steam pipe is coaxially sleeved outside the heat absorbing pipe, and a pipe diameter satisfies a specific formula; cold water and steam flow in the heat absorbing pipe and the steam pipe, respectively, forming bifacial all-natural convection heat transfer inside and outside; layers of the sleeved pipeline are connected in series in a stepped staggered manner and placed on an inclined flat plate with a given slope; every two layers of stepped sleeved pipeline are connected by a detachable sleeved U-shaped pipe and a curved water collecting pipe; the outlet of the condensed water collecting chamber is provided with an air valve; the stepped sleeved pipeline and the condensed water collecting chamber are arranged in the heat insulation shell.

4 Claims, 3 Drawing Sheets

(56) References Cited

FOREIGN PATENT DOCUMENTS

| | | | | |
|---|---|---|---|---|
| CN | 111998700 | A | | 11/2020 |
| CN | 216951889 | U | * | 7/2022 |
| KR | 20040082686 | A | | 9/2004 |

OTHER PUBLICATIONS

Notice Of Allowance(CN202210948868.9); Date of Mailing: Oct. 28, 2023.
Heat-transfer-characteristics-in-circulating-solar-heat-tubes-based-on-gas-liquid-two-phase-flow.

* cited by examiner

STEPPED SELF-CONVECTION CONDENSER

CROSS-REFERENCE TO RELATED APPLICATIONS

The present application is a continuation of International Application No. PCT/CN2022/111090, filed on Aug. 9, 2022, the contents of which is incorporated herein by reference in its entirety.

TECHNICAL FIELD

The present disclosure relates to the field of condensers, and in particular, to a stepped self-convection condenser.

BACKGROUND

A condenser is one of the main devices in power systems and refrigeration systems. The function of the condenser is to exchange heat between heat source and cold source, so as to recycle energy, or to cool the polluted heat source and then discharge it, so as to reduce environmental pollution.

Condensers are mainly divided into hybrid condensers and recuperative condensers according to the contact mode, among which recuperative condensers are suitable for situations where two fluids cannot or are not desired to contact directly, and the application range is wider. There are many forms of recuperative condenser, such as plate type, shell-and-pipe type and sleeve type. Among them, the shell-and-pipe heat exchanger has some problems, such as short contact time between cold and heat sources, limited temperature difference between cold and heat sources, and low heat exchange efficiency. The flow of hot fluid and cold fluid in the sleeve-type heat exchanger needs pumping force, and natural flow and natural convection cannot be realized; the condensate can not be quickly collected to the bottom layer, and the condensate adheres to the pipe wall to increase the heat exchange resistance; various pipeline are connected by a fixed U-shaped pipe, which are not easy to maintain; there is no shell protection outside, so the heat dissipation with the external environment is inevitable, which is greatly influenced by the external environment, and the outer pipe is easy to wear and tear; the ratio of inner pipe diameter to the outer pipe diameter and the ratio of velocity to flow rate are not clearly set, and the consumption of cold fluid is large, which has the problems of low heat exchange efficiency and heat energy utilization rate.

SUMMARY

In view of the shortcomings of the prior art, the present disclosure provides a stepped self-convection condenser to solve the problems of short contact time of cold and heat sources, difficulty in forming natural flow convection, large heat exchange resistance caused by condensate adhesion, low heat exchange rate, insufficient energy recycling and the like.

In order to achieve the above object, the present disclosure is realized by adopting the following technical solution:

A stepped self-convection condenser includes a stepped heat absorbing pipe, a stepped steam pipe, a curved water collecting pipe, a condensed water collecting chamber and a heat insulation shell;

the stepped heat absorbing pipe and the stepped steam pipe are coaxially sleeved to form a stepped sleeved pipeline; a diameter of the stepped heat absorbing pipe is smaller than that of the stepped steam pipe;

various layers of the sleeved pipeline is connected in series in a stepped staggered manner and placed on an inclined flat plate with a given gradient J, every two stepped sleeved pipelines in each layer are connected by a sleeved U-shaped pipe, and every two layers of stepped sleeved pipeline are connected by the sleeved U-shaped pipe and the curved water collecting pipe; a shape of the curved water collecting pipe meets an equation of elliptic revolution, and the expression is as follows:

$$(x^2+y^2)+\frac{(z-d_v)^2}{2}=\left(\frac{d_v}{4}\right)^2;$$

where x, y and z represent three directions that constitute a spatial coordinate system, with a direction setting satisfying the right-hand rule of a Cartesian coordinate system;

the condensed water collecting chamber is connected with the curved water collecting pipe and is provided with an air valve and a water outlet; the condensed water collecting chamber and the stepped sleeved pipeline are arranged in the heat insulation shell, the condensed water collecting chamber is located in the shell near the bottom, and the stepped sleeved pipeline is located above the condensed water collecting chamber;

a diameter $d_l$ of the heat absorbing pipe and a diameter $d_v$ of the steam pipe satisfy a formula $$d_l=\frac{d_v}{1+T_r},$$

where a heat transfer ratio $$T_r=\frac{h_l}{h_v},$$

$h_l$ and $h_v$, refer to a cold water heat transfer coefficient and a steam heat transfer coefficient respectively; cold water naturally flows from top to bottom in the stepped heat absorbing pipe, and steam naturally flows from bottom to top between the stepped heat absorbing pipe and the stepped steam pipe, forming bifacial all-natural convection heat transfer inside and outside.

Further, a steam passage is formed between the stepped steam pipe and the stepped heat absorbing pipe, and steam naturally flows along the steam passage from a lower inlet of the shell from bottom to top, and performs bifacial all-natural convection heat transfer with the cold water in the heat absorbing pipe according to a mass flow ratio $k_m$, and phase change occurs to generate condensed water; a mathematical expression of the mass flow ratio $k_m$ is:

$$\kappa_m=\frac{c_l\cdot\Delta t_l}{r_v};$$

where $c_l$ is a specific heat capacity of cold water, $r_v$ is latent heat of steam, $\Delta t_l$ is a temperature difference of cold water heat exchange;

the condensed water flows into the condensed water collecting chamber at a lower part of the shell from top to bottom along a steam passage through a water collection curved pipe; the curved water collecting pipe whose crosssectional shape satisfies the elliptic equation makes the condensed water in the steam passage in an upper layer be quickly collected to a lower layer.

Further, the diameter of the stepped heat absorbing pipe is smaller than that of the stepped steam pipe; cold water flows from an upper inlet of the shell to the bottom along the stepped heat absorbing pipe, and performs natural convection heat exchange with steam outside the heat absorbing pipe at a flow rate ratio $\dot{U}$, and a mathematical expression thereof is as follows:

$$\dot{U} = \frac{\kappa_\rho}{\kappa_m}\left[\left(\frac{d_v}{d_l}\right)^2 - 1\right],$$

where a density ratio $$\kappa_\rho = \frac{\rho_v}{\rho_l},$$

and $\rho_v$, $\rho_l$ are a steam density and a cold water density respectively.

Further, various layers of the stepped sleeved pipeline are connected in series in a stepped staggered manner and placed on the inclined flat plate with a given slope J, where J is 2%-3%; the sleeved pipelines of various layer are connected in series by the sleeved U-shaped pipes in a transverse direction with a slope J; the sleeved pipeline of each layer is equipped with a velocity control valve, so that a mathematical expression of a cold water velocity in the heat absorbing pipe is as follows:

$$V = \sqrt{\frac{2d_l Jg}{\lambda}} \in \frac{4}{\pi d_l^2 \tau}(W_{min}, W_{max})$$

where $W_{min}$ and $W_{max}$ are respectively a minimum output and a maximum output of condensed water per day, $\lambda$ is an on-way resistance coefficient, $\tau$ is a daily working time, and g is gravity acceleration; every two layers of sleeved pipeline are connected by the curved water collecting pipe and the sleeved U-shaped pipe, and the curved water collecting pipe and the sleeved U-shaped pipe are located at different ends of upper and lower layers of pipes, connecting an upper end pipe and a lower head pipe; and inner and outer pipes of the sleeved U-shaped pipe have diameters of $d_l$ and $d_v$ respectively, and are connected by vertical serial flanges, which are detachable interfaces.

Further, the condensed water collecting chamber is located at a lower part of the shell, connected with the bottom curved water collecting pipe, and collects the condensed water in the stepped sleeved pipeline; the bottom of the collecting chamber is provided with a water outlet and an air valve, and the air valve is installed at the water outlet; when the condenser works, the air valve is in a closed state, the condensed water is stored in the collecting chamber, and a working environment set in the condenser is maintained to be higher than or lower than the normal pressure; when the condenser stops working completely, the air valve is opened to adjust the pressure in the condenser to the normal pressure, and the condensed water is discharged from the condenser.

In an embodiment, the heat insulation shell is horizontally cylindrical.

According to the above technical solution, the present disclosure has the following beneficial effects.

On the premise of good protection and heat insulation for internal pipes by the device, the unique pipe design makes cold and heat sources completely naturally convect, reducing energy consumption and saving energy; according to the set pipe diameter ratio and flow rate-slope relationship, the cold and heat sources can get enough contact time and heat transfer area to achieve the expected heat exchange, effectively realize the heat exchange, save the amount of cold sources, and improve the heat utilization rate and heat exchange efficiency; the design of the curved water collecting pipe can quickly collect condensed water to the bottom layer and reduce thermal resistance; the air valve is closed when the condenser works and opened when it is stopped, which can effectively maintain the internal pressure and is suitable for both high pressure and negative pressure, that is, the operating pressure range is enlarged and the residual steam and water droplets in the device are automatically removed; in addition, occupation area is significantly reduced by layered superimposition.

BRIEF DESCRIPTION OF DRAWINGS

The accompanying drawings, which constitute a part of the present disclosure, are used to provide a further comprehension of the present disclosure, and the illustrative embodiments of the present disclosure and their descriptions are used to explain the present disclosure, and do not constitute undue limitations on the present disclosure.

Reference Signs: 1, Stepped heat absorbing pipe; 2, Stepped steam pipe; 3, Curved water collecting pipe; 4, Condensed water collecting chamber; 5, Heat insulation shell; 6, Stepped sleeved pipeline; 7, Sleeved U-shaped pipe; 8, Inclined flat plate.

DESCRIPTION OF EMBODIMENTS

It should be appreciated that the embodiments in this application and the features in the embodiments can be combined with each other without conflict. The present disclosure will be described in detail with reference to the attached drawings and examples.

Figure 1:
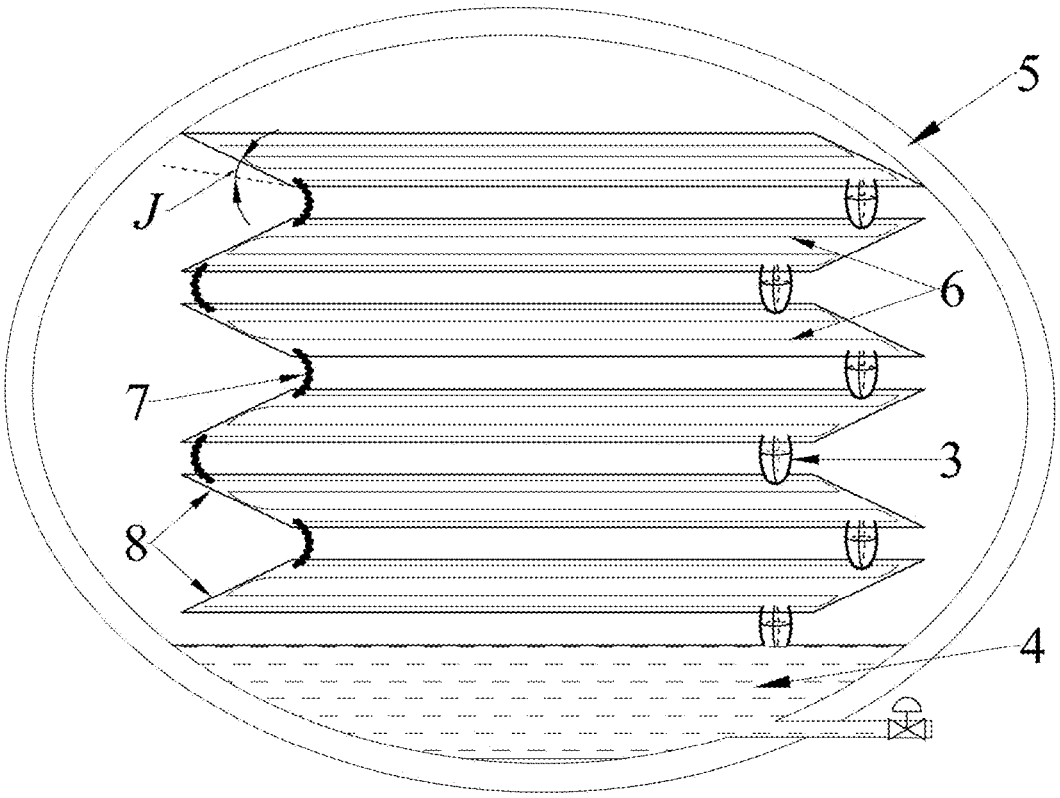
FIG. 1 is a side view of a stepped self-convection condenser provided by an embodiment of the present disclosure.
Figure 2:
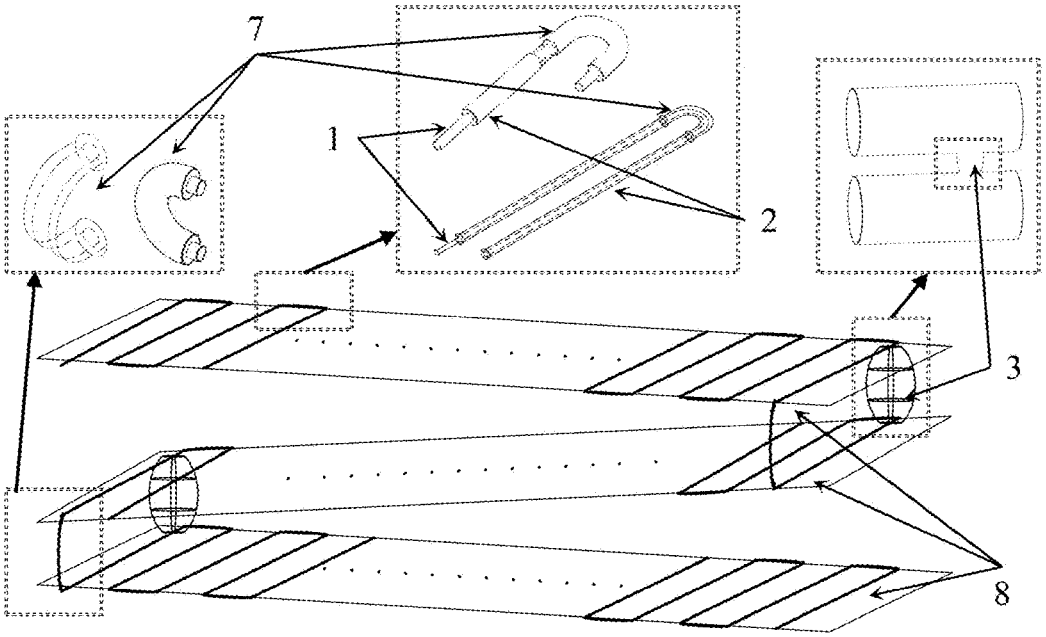
FIG. 2 is a side view of the stepped sleeved pipeline provided by an embodiment of the present disclosure.
Figure 3:
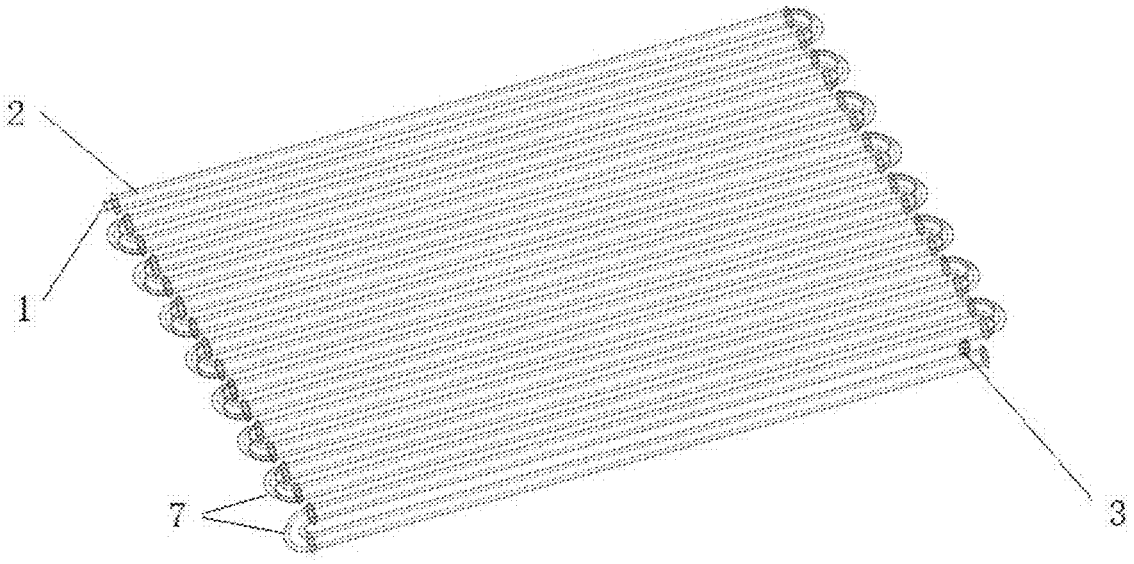
FIG. 3 is a top view of the stepped sleeved pipeline provided by an embodiment of the present disclosure.

Referring to FIGS. 1-3, an embodiment of the present disclosure provides a stepped self-convection condenser, which includes a stepped heat absorbing pipe 1, a stepped steam pipe 2, a curved water collecting pipe 3, a condensed water collecting chamber 4 and a heat insulation shell 5; the stepped heat absorbing pipe 1 and the stepped steam pipe 2 are coaxially sleeved to form a stepped sleeved pipeline; a diameter of the stepped heat absorbing pipe 1 is smaller than that of the stepped steam pipe 2, and a stepped sleeved pipeline 6 is formed, a diameter $d_l$ of the heat absorbing pipe and a diameter $d_v$ of the steam pipe satisfy a formula $$d_l = \frac{d_v}{1 + T_r},$$

where a heat transfer ratio $$T_r = \frac{h_l}{h_v},$$

$h_l$ and $h_v$ refer to a cold water heat transfer coefficient and a steam heat transfer coefficient respectively.

Cold water naturally flows from top to bottom in the stepped heat absorbing pipe 1, and steam naturally flows from bottom to top between the stepped heat absorbing pipe 1 and the stepped steam pipe 2, forming bifacial all-natural convection heat transfer inside and outside; various layers of the sleeved pipeline is connected in series in a stepped staggered manner and placed on an inclined flat plate 8 with a given gradient J, every two stepped sleeved pipelines in each layer are connected by a sleeved U-shaped pipe 7, and every two layers of stepped sleeved pipeline 6 are connected by the sleeved U-shaped pipe 7 and the curved water collecting pipe 3; a shape of the curved water collecting pipe 3 meets an equation of elliptic revolution, and the expression is as follows:

$$(x^2 + y^2) + \frac{(z - d_v)^2}{2} = \left(\frac{d_v}{4}\right)^2,$$

where x, y and z represent three directions that constitute a spatial coordinate system, with a direction setting satisfying the right-hand rule of a Cartesian coordinate system.

The condensed water collecting chamber 4 is connected with the curved water collecting pipe 3 and is provided with an air valve and a water outlet; the condensed water collecting chamber 4 and the stepped sleeved pipeline 6 are arranged in the heat insulation shell 5, the condensed water collecting chamber 4 is located in the shell near the bottom, and the stepped sleeved pipeline 6 is located above the condensed water collecting chamber 4.

It should be noted that the complete natural convection heat exchange between steam and cold water can reduce energy consumption, and the design of the layered, sleeved and stepped pipelines 6 can effectively reduce the occupied area on the premise of improving heat exchange efficiency; the curved water collecting pipe 3 is designed and processed according to the shape equation, which can effectively prevent the condensed water from adhering to the pipe wall when it flows through the curved pipe without increasing the processing difficulty, so as to quickly collect the condensed water of each layer; the relationship formula between pipe diameters and the shape equation of the curved water collecting pipe 3 are both for improving heat exchange efficiency and heat exchange effect, which can be adjusted according to the processing situation and heat exchange conditions in practical application.

In this embodiment, a steam passage is formed between the stepped steam pipe 2 and the stepped heat absorbing pipe 1, and steam naturally flows along the steam passage from a lower inlet of the shell from bottom to top, and performs bifacial all-natural convection heat transfer with the cold water in the heat absorbing pipe according to a mass flow ratio $$\kappa_m = \frac{c_l \cdot \Delta t_l}{r_v},$$

and phase change occurs to generate condensed water; the condensed water flows into the condensed water collecting chamber 4 at a lower part of the shell from top to bottom along a steam passage through a water collection curved pipe 3; cold water flows from an upper inlet of the shell to the bottom along the stepped heat absorbing pipe 1, and performs natural convection heat exchange with steam outside the heat absorbing pipe at a flow rate ratio $$\dot{U} = \left[\left(\frac{d_v}{d_l}\right)^2 - 1\right],$$

where a density ratio $$\kappa_\rho = \frac{\rho_v}{\rho_l}.$$

It should be noted that ci in the above formula is the specific heat capacity of cold water, $r_v$ is the latent heat of steam, and ρ is the density of steam and cold water, $\Delta t_l$ is the temperature difference of cold water heat exchange; the curved water collecting pipe 3 designed between every two layers can make the condensed water in the steam pipe 2 of each layer quickly be collected to the bottom layer and finally flow into the condensed water collecting chamber 4, which can effectively reduce the flow resistance and thermal resistance of each layer, improve the heat exchange effect and enhance the heat exchange efficiency.

In this embodiment, various layers of the stepped sleeved pipeline 6 are connected in series in a stepped staggered manner and placed on the inclined flat plate 8 with a given slope J, where J is 2%-3%; the sleeved pipelines 6 of various layer are connected in series by the sleeved U-shaped pipes 7 in a transverse direction with a slope J; the sleeved pipeline of each layer is equipped with a velocity control valve, so that the cold water velocity in the heat absorbing pipe 1 satisfies:

$$V = \sqrt{\frac{2d_l Jg}{\lambda}} \in \frac{4}{\pi d_l^2 \tau}(W_{min}, W_{max}),$$

where, $W_{min}$ and $W_{max}$ are respectively a minimum output and a maximum output of condensed water per day, λ is an on-way resistance coefficient, τ is a daily working time.

It should be noted that the flow rate of cold water is controlled by the flow rate control valve according to the flow rate limit formula, which can ensure that enough steam is treated without consuming too much cold water, reduce the consumption of cold water, effectively ensure the working rate and heat exchange efficiency, and also play a role in saving energy; this device uses the inclined flat plate 8 to support the stepped sleeved pipeline 6, in order to stabilize the pipeline, reduce the increase of pipe vibration and thermal stress caused by velocity or temperature difference, enlarge the application range of the pipe, and play a better role in protecting the pipe.

In this embodiment, the sleeved U-shaped pipe 7 connecting the stepped sleeved pipeline 6 in each layer is a sleeved U-shaped pipe 7 with a common fixed interface, which can ensure the tightness between pipes in each layer; the sleeved U-shaped pipes 7 of every two layers of stepped sleeved pipelines 6 are connected by vertical serial flanges, which are a detachable interface, and a gasket is arranged at the interface, which can avoid the leakage problem of the interface. The purpose of arranging the detachable sleeved U-shaped pipe 7 between each two layers is to facilitate the later maintenance and overhaul of the device.

In this embodiment, the condensed water collecting chamber 4 is located at the lower part of the heat insulation shell 5, connected with the bottom curved water collecting pipe 3, and collects the condensate in the stepped sleeved pipeline 6; the bottom of the collecting chamber 4 is provided with a water outlet and an air valve, and the air valve is installed at the water outlet; when the condenser works, the air valve is in a closed state, the condensed water is stored in the collecting chamber 5, and the working environment set in the condenser is maintained to be higher than or lower than the normal pressure; when the condenser stops working completely, the air valve is opened to adjust the pressure in the condenser to normal pressure, and the condensed water is discharged from the condenser. The design of the condensed water collecting chamber 4 can allow the device to be run in high pressure or negative pressure environment, which is suitable for both high pressures and negative pressures, that is, the operating pressure range is enlarged, and the heat insulation effect between the environment and the upper stepped sleeved pipeline 6 can be improved to ensure the heat energy utilization rate. The air pressure value of the high pressure or negative pressure is based on the pressure value of the normal pressure.

In this embodiment, the heat insulation shell 5 is horizontally cylindrical, which has low requirements for materials and only needs to meet simple requirements such as dust prevention, heat preservation and pipe fixing. The design of a horizontal cylindrical shape can effectively utilize the area, and the purpose of setting the heat insulation shell 5 is to reduce the heat dissipation of the stepped sleeved pipeline 6 to the external environment, avoid the pipe from being affected by environmental conditions, and effectively prolong the service life of the pipeline.

The negative pressure heat exchange of water vapor and cold water in the stepped self-convection condenser is taken as an example.

Heat exchange process: water vapor enters from the bottom stepped sleeved pipeline 6 and naturally floats from bottom to top between the pipe rings of the heat absorbing pipe 1 and the steam pipe 2; cold water enters from the top stepped sleeved pipeline 6, and naturally flows from top to bottom in the heat absorbing pipe 1; steam and cold water form bifacial all-natural convection heat transfer, during which the temperature of cold water rises to form medium-high temperature hot water flowing out of the condenser, and this part of hot water can be collected and utilized as a heat source; the phase change of water vapor produces condensed water, which quickly flows to the lower layer along the curved water collecting pipe and finally flows into the condensed water collecting chamber 4, and this part of condensed water can be collected and utilized as a clean water source.

Condensed water discharge process: taking the heat exchange in the device as an example, steam and cold water exchange heat in a pressure environment below atmospheric pressure, and the generated condensed water is also in the same pressure range. An air valve is set at the outlet of the collecting chamber 5. When the device is running, the air valve is closed, and the condensed water is stored in the collecting chamber 4. After one-day running of the device, the air valve is opened, and the atmospheric pressure is balanced with the pressure in the pipe. Finally, the pressure in the device is restored to atmospheric pressure, and the condensed water flows out of the collecting chamber 4. In the process of pressure balance, the residual steam and water droplets in the device are removed through the circulation of air to ensure the normal operation of the next day.

What has been described above is only the preferred embodiment of the present disclosure, and it is not used to limit the present disclosure. For those skilled in the art, the present disclosure may have various modifications and changes. Any modification, equivalent substitution, improvement, etc. made within the spirit and principle of the present disclosure shall be included in the protection scope of the present disclosure.

What is claimed is:

1. A stepped self-convection condenser, comprising:

a stepped heat absorbing pipe, a stepped steam pipe, wherein the stepped heat absorbing pipe and the stepped steam pipe are coaxially sleeved to form stepped sleeved pipelines; and a diameter of the stepped heat absorbing pipe is smaller than a diameter of the stepped steam pipe;

a curved water collecting pipe, wherein each layer of the stepped sleeved pipelines is connected to another layer of the stepped sleeved pipelines in series in a stepped staggered manner and placed on an inclined flat plate with a given gradient J, every two stepped sleeved pipelines in each layer are connected to each other by a sleeved U-shaped pipe, and every stepped sleeved pipelines layer is connected to each other by the sleeved U-shaped pipe and the curved water collecting pipe; a condensed water between the stepped steam pipe and the stepped heat absorbing pipe flows into a condensed water collecting chamber at a lower part of a heat insulation shell through the curved water collecting pipe; and a shape of the curved water collecting pipe satisfies an equation of elliptic revolution as follows:

$$(x^2 + y^2) + \frac{(z - d_v)^2}{2} = \left(\frac{d_v}{4}\right)^2;$$

where x, y and z represent three directions that constitute a spatial coordinate system, with a direction setting satisfying the right-hand rule of a Cartesian coordinate system;

the condensed water collecting chamber connected with the curved water collecting pipe and provided with an air valve and a water outlet; and the heat insulation shell, wherein the condensed water collecting chamber and the stepped sleeved pipeline are arranged in the heat insulation shell, the condensed water collecting chamber is located in the shell near a bottom of the shell, and the stepped sleeved pipeline is located above the condensed water collecting chamber;

wherein a diameter $d_1$ of the heat absorbing pipe and a diameter $d_v$ of the steam pipe satisfy a formula $$d_l = \frac{d_v}{1 + T_r};$$

with a heat transfer ratio $$T_r = \frac{h_l}{h_v},$$

$h_l$ and $h_v$ represent a cold water heat transfer coefficient and a steam heat transfer coefficient, respectively; cold water naturally flows from top to bottom in the stepped heat absorbing pipe, and steam naturally flows from bottom to top between the stepped heat absorbing pipe and the stepped steam pipe, forming bifacial all-natural convection heat transfer inside and outside the stepped heat absorbing pipe.

2. The stepped self-convection condenser according to claim 1, wherein each layer of the stepped sleeved pipeline is connected to another layer of the stepped sleeved pipelines in series in a stepped staggered manner and placed on the inclined flat plate with a given gradient J, where J is within a range of 2%-3%; every two stepped sleeved pipelines in each layer are connected to each other by a sleeved U-shaped pipe, and each layer of the stepped sleeved pipelines is connected to each other in series by the sleeved U-shaped pipes and the curved water collecting pipe; and each layer of the stepped sleeved pipelines is provided with a velocity control valve, wherein a mathematical expression of a cold water velocity in the heat absorbing pipe is as follows:

$$V = \sqrt{\frac{2d_l Jg}{\lambda}} \in \frac{4}{\pi d_l^2 \tau}(W_{min}, W_{max})$$

where $W_{min}$ and $W_{max}$ represent a minimum output and a maximum output of condensed water per day, respectively, λ represents an on-way resistance coefficient, τ represents a daily working time, and g represents gravity acceleration; every stepped sleeved pipelines layer is connected to each other by the curved water collecting pipe and the sleeved U-shaped pipe, and the curved water collecting pipe and the sleeved U-shaped pipe are located at different ends of upper and lower layers of the pipelines, connecting an upper end pipe and a lower head pipe; wherein diameters of inner and outer pipes of the sleeved U-shaped pipe are $d_l$ and $d_v$, respectively, and are connected by vertical serial flanges with detachable interfaces.

3. The stepped self-convection condenser according to claim 1, wherein the condensed water collecting chamber is provided at a lower part of the shell and connected with the bottom curved water collecting pipe, and collects condensed water in the stepped sleeved pipeline; a water outlet and an air valve are provided at a bottom of condensed water collecting chamber, and the air valve is installed at the water outlet; and wherein when the condenser works, the air valve is in a closed state, the condensed water is stored in the collecting chamber, and a working environment set in the condenser is maintained to be higher than or lower than a normal pressure; and when the condenser stops working completely, the air valve is opened to adjust a pressure in the condenser to the normal pressure, and the condensed water is discharged from the condenser.

4. The stepped self-convection condenser according to claim 1, wherein the heat insulation shell is horizontally cylindrical.

* * * * *